US009249703B2

(12) United States Patent
Harris et al.

(10) Patent No.: US 9,249,703 B2
(45) Date of Patent: Feb. 2, 2016

(54) COMPACT MUFFLER FOR SMALL TWO-STROKE INTERNAL COMBUSTION ENGINES

(71) Applicants: Chris B. Harris, Amity, OR (US); Chris A. Pellegrino, Yamhill, OR (US); Gregory J. Stadeli, Silverton, OR (US); Dean W. Glass, Carlton, OR (US)

(72) Inventors: Chris B. Harris, Amity, OR (US); Chris A. Pellegrino, Yamhill, OR (US); Gregory J. Stadeli, Silverton, OR (US); Dean W. Glass, Carlton, OR (US)

(73) Assignee: NORTHWEST ULD, INC., McMinnville, OR (US)

( * ) Notice: Subject to any disclaimer, the term of this patent is extended or adjusted under 35 U.S.C. 154(b) by 0 days.

(21) Appl. No.: 14/076,859

(22) Filed: Nov. 11, 2013

(65) Prior Publication Data

US 2014/0332312 A1 Nov. 13, 2014

Related U.S. Application Data

(63) Continuation of application No. 13/546,210, filed on Jul. 11, 2012, now Pat. No. 8,602,159.

(60) Provisional application No. 61/515,156, filed on Aug. 4, 2011.

(51) Int. Cl.

| | |
|---|---|
| ***F01N 1/10*** | (2006.01) |
| ***F01N 1/24*** | (2006.01) |
| ***F01N 1/12*** | (2006.01) |
| *F01N 13/16* | (2010.01) |

(52) U.S. Cl.

CPC *F01N 1/24* (2013.01); *F01N 1/125* (2013.01); *F01N 13/16* (2013.01); *F01N 2470/18* (2013.01); *F01N 2490/16* (2013.01)

(58) Field of Classification Search

CPC ..... F01N 1/10; F01N 1/24
USPC ..... 181/256, 212
See application file for complete search history.

(56) References Cited

U.S. PATENT DOCUMENTS

| | | | | |
|---|---|---|---|---|
| 3,009,531 | A * | 11/1961 | Mead | 181/239 |
| 3,066,755 | A | 12/1962 | Diehl | |
| 3,068,079 | A * | 12/1962 | Purse et al. | 422/176 |
| 3,672,773 | A * | 6/1972 | Moller | 81/256 |
| 3,692,142 | A | 9/1972 | Stemp | |
| 3,744,589 | A | 7/1973 | Mellin | |
| 3,927,731 | A | 12/1975 | Lancaster | |
| 4,579,195 | A | 4/1986 | Nieri | |
| 4,867,270 | A * | 9/1989 | Wissmann et al. | 181/231 |
| 5,612,006 | A | 3/1997 | Fisk | |
| 6,684,633 | B2 | 2/2004 | Jett | |
| 6,789,644 | B2 * | 9/2004 | Mukaida | 181/272 |
| 6,959,782 | B2 | 11/2005 | Brower et al. | |
| 7,472,774 | B1 | 1/2009 | Monson et al. | |
| 7,530,428 | B2 * | 5/2009 | Feist et al. | 181/264 |
| 7,712,578 | B2 * | 5/2010 | Han | 181/272 |
| 7,721,845 | B2 | 5/2010 | Gorenflo | |
| 8,006,801 | B2 * | 8/2011 | Christoffers et al. | 181/230 |
| 2005/0023078 | A1 * | 2/2005 | Brower et al. | 181/272 |
| 2011/0180347 | A1 | 7/2011 | Butler | |

* cited by examiner

*Primary Examiner* — Forrest M Phillips
(74) *Attorney, Agent, or Firm* — Marsh Fischmann & Breyfogle LLP

(57) ABSTRACT

A muffler providing a compact and low-profile form factor for small two-stroke engines is described, particularly useful for aerodynamic radio controlled aircraft. The muffler comprises a tuned internal header eliminating the need for an external header to mount the inventive muffler to the exhaust port of a two-stroke engine while maintaining enhanced engine performance, obviating the need for a conventional tuned-pipe exhaust.

21 Claims, 5 Drawing Sheets

COMPACT MUFFLER FOR SMALL TWO-STROKE INTERNAL COMBUSTION ENGINES

PRIORITY CLAIM

This application is a continuation of U.S. patent application Ser. No. 13/546,210, filed on Jul. 11, 2012, which is a non-provisional patent application of, and claims priority to, U.S. Provisional Application 61/515,156, filed on Aug. 4, 2011. Priority is claimed to each of the above-noted patent applications, and the entire disclosure of each such patent application is hereby incorporated by reference.

FIELD OF THE INVENTION

This invention relates to compact mufflers designed for small two-stroke engines used in radio controlled model aircraft, watercraft, hand held tools and the like.

BACKGROUND

Over the past several decades, muffler designs aiming at compactness and light weight have been introduced in order to accommodate the demands of modern vehicle designs. Being primarily directed to use with four-stroke engines in automobiles and motorcycles, prior art muffler designs have been focused on reducing the size of the muffler system and for enhancing engine efficiency by maintaining low back pressure while adequately reducing exhaust noise by different means. In these designs, the exhaust pipe is partially or wholly enclosed within the body of the muffler to accommodate a duct shaped in a "jellyroll" or spiral passageway enclosed in an outer shell comprising the muffler housing. The spiral passageway is of reduced cross section relative to the header pipe in which exhaust gases increase in velocity and reduced pressure in a gradual manner, thereby greatly reducing the noise associated with the expansion of these gases, while maintaining low pressure and forward flow within the muffler so as greatly lower the backpressure on the engine. Examples of such designs are described in U.S. Pat. No. 3,066,755 to Diehl, U.S. Pat. No. 3,692,142 to Stemp, U.S. Pat. No. 3,927,731 to Lancaster. Later, more elaborate methods of noise abatement were combined with the spiral flow passage, as exemplified in U.S. Pat. No. 4,579,195 to Nieri and U.S. Pat. No. 5,612,006 to Fisk.

More recently, streamlining muffler systems for two-stroke engines has been addressed. For a two-stroke engine, backpressure is an issue, but in the opposite sense in relation to four-stroke engines, and efforts have been made to design an exhaust system to maintain a certain level of backpressure so that the air/fuel mixture does not empty too quickly from the cylinder on the down-stroke of the piston. The quintessential exhaust processing system for a two-stroke engine has been the tuned straight pipe, adding to the passive backpressure control of the air/fuel charge in the cylinder by sending positive pressure pulses to the cylinder synchronized with the down-stroke to push fresh un-combusted air/fuel charge that had escaped into the exhaust system back into the cylinder just before the compression/combustion stroke of the piston. While the straight tuned pipe works well to enhance two-stroke engine efficiency, and reduce exhaust system noise, in the case of small vehicles and hand tools powered by small two-stroke engines, tuned pipes are in many instances longer and bulkier than the very vehicle or devices on which they are mounted, adding significant weight as well. For instance, radio controlled model aircraft are hampered by the presence of a tuned pipe exhaust because it is difficult to hide or streamline the tuned pipe for increasing aerodynamic efficiency. U.S. Pat. No. 6,684,633 to Jett addresses this issue and describes a compact muffler designed for radio controlled aircraft and small engine-powered tools. U.S. Pat. No. 6,959,782 to Brower et al. describes a muffler design based on similar principles for two-cylinder two-stroke motorcycle engines. Both designs comprise compact "tuned" exhaust systems, whereby the tuned exhaust pipe is rolled into a spiral passage leading to an expansion chamber. These mufflers are claimed to be effectively tuned pipes folded into a compact form factor, however fall short of a perfect tuned pipe exhaust because of the combination of the abrupt angles along the folded course of flow, and the rectangular cross section of the spiral passage itself, effectively frustrate the propagation of pressure waves, greatly detuning the system.

BRIEF DESCRIPTION OF THE INVENTION

While the latter prior designs address some of the problems mentioned in the Background section, the instant invention solves the problem of providing an effective compact muffler system without the need to have a conventional tuned pipe exhaust for good engine performance, yet still maintain or enhance engine performance, provide noise attenuation and very importantly provide a low-profile form-factor when mounted on an engine to allow for streamlined and aerodynamic vehicle design, such as for radio controlled aircraft and watercraft powered by small two-stroke engines. The inventors provide a lightweight highly compact muffler design for mounting on small two-stroke engines, providing the benefits of a tuned pipe exhaust system without the inconvenience of the extra weight and space requirements that a tuned pipe necessitates. This aspect of the instant invention is especially beneficial for radio controlled model aircraft and unmanned aerial vehicles (UAVs), where the ability to encase the muffler fully within the engine compartment of the fuselage does not engender drag that would normally be encountered by a more bulky exhaust system, and allows operation of the small aircraft with full aerodynamic efficiency, as intended by the aircraft's designers. The inventive muffler is mounted directly or almost directly on the engine, being connected to a shorted exhaust pipe from a manifold or header system, or directly to the engine exhaust port.

The preferred embodiment of the invention comprises a substantially cylindrical shell housing having a low aspect ratio and divided into at least four removable or separable cylindrical sections that shared a common axis and are assembled into a stack, fastened together by one or more bolts that extend through the muffler body parallel to the axis, when in use. The muffler can be readily disassembled for servicing by means of this design. The shell housing is divided internally into at least three chambers consisting of a middle chamber and two auxiliary outer chambers sharing a common axis and arranged in a stack. In the preferred embodiment, the outer chambers are arranged above and below the middle chamber and share common internal partitions with the middle chamber. An intake port flange is integrally formed in and on the body of the upper chamber delineated and partially enclosed by the first shell section, disposed near the edge thereof and penetrating through the interior of the upper chamber via an integrally formed duct to reach and communicate with the middle chamber. A stinger exhaust outlet is similarly integrally formed in and on the body, comprising a tube and conical diffuser section disposed within and outside of the lower chamber, delineated and enclosed partially by the fourth shell section. The stinger exhaust outlet port is integrally formed with the fourth shell section, and is partially disposed on the interior of the shell to reach and communicate with the middle chamber. The exhaust stinger tube section is aerodynamically designed for minimal disturbance to the flow path of the exiting exhaust gases to minimize overly high backpressure due to turbulence effects, and seamlessly diverges to form the conical diffuser section for efficient flow ejection to the atmosphere. The middle chamber in turn is composed of two half chambers delineated and encompassed by the second and third sections of the housing shell forming an outer wall, internally bounded by an upper partition plate separating the upper chamber from the top of the middle chamber and a lower partition plate separating the lower chamber from the bottom of the middle chamber, wherein a spiral inner wall spanning the middle chamber from the top partition plate to the bottom partition plate is formed integrally with the upper and lower partition plates, and has an origin that bifurcates inwardly from the outer wall, winding spirally towards the center of the middle chamber. The windings of the spiral wall delineate a spiral exhaust passage having a peripheral terminus disposed near the periphery of the middle chamber, and an inner terminus disposed near the center of the middle chamber. Enclosed within the spiral exhaust passage and disposed at the peripheral terminus is an entrance aperture in communication with the intake port, whereas an exit aperture in communication with the exhaust outlet port is also enclosed within the spiral passage and disposed at its inner terminus. The exhaust port further comprises a duct formed integrally with the shell section housing the lower chamber, leading to the stinger outlet. The stinger outlet further comprises a straight tubular duct of narrow bore, also formed integrally with the shell section housing of the lower chamber, leading to the exterior of the lower chamber, where an integrally formed flared outlet penetrates the shell section of the lower chamber to vent exhaust to the atmosphere.

Disposed on both the upper and lower partition plates of the middle chamber is a plurality of perforations arranged in a pattern following the contours of the spiral passage. The perforations occupy only a portion of the spiral chamber defined as the aft-portion, whereby an initial segment extending from the aperture at the peripheral terminus to a point along the spiral passage, defined as the fore-portion, is not perforated. The fore-portion of the spiral exhaust passage forms an internal header. An adjustment of the length of the internal header is performed empirically to yield maximum engine performance for a particular engine. The plurality of perforations in the aft-portion of the spiral exhaust passage allow communication between the passage and the interior of the upper and lower auxiliary chambers, wherein a sound dampening material packing is enclosed. Gases passing through the spiral exhaust passage follow the internal header to the aft-portion wherein the gases enter the auxiliary chambers through the perforations and interact with the sound absorbent packing where the sound energy that they carry is dissipated. The gases then re-enter the spiral chamber to be exhausted to the atmosphere through the stinger outlet. In an aspect of the present invention, the gases do not pass through the sound dampening material, extending the service life of the material.

The inventive muffler thus provides a simple and highly compact form factor and construction for low profile mounting on small two-stroke engines, while at the same time yielding enhanced performance, obviating the need for an unwieldy conventional tuned pipe exhaust that adds unnecessary bulk and weight to light-weight aerodynamic vehicles and small apparatuses powered by small two-stoke engines, such as radio controlled aircraft, watercraft and UAVs. The inventive muffler provides this enhancement by maintaining adequate backpressure on the cylinder to which it is mounted, reducing the potential for gases to escape too rapidly during the scavenging phase on the down-stroke of the piston.

DETAILED DESCRIPTION

Figure 1A:
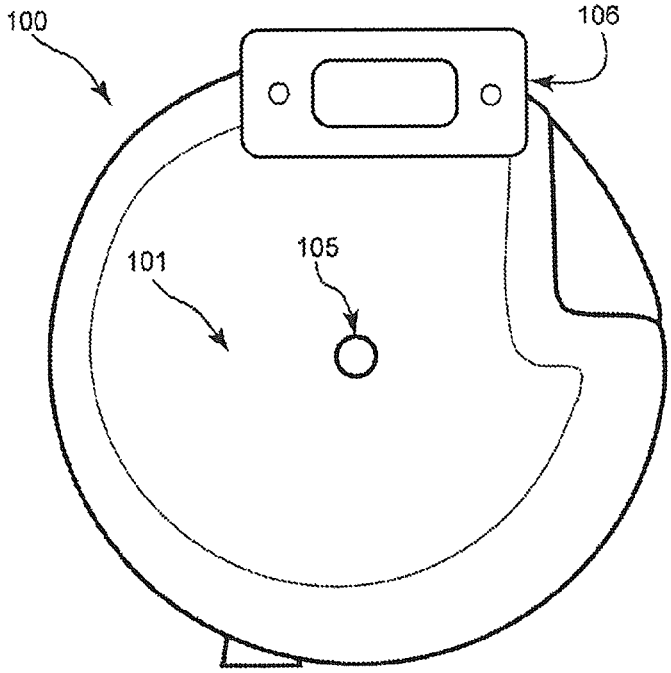
FIG. 1*a*. A frontal (top) view of the invention
Figure 1B:
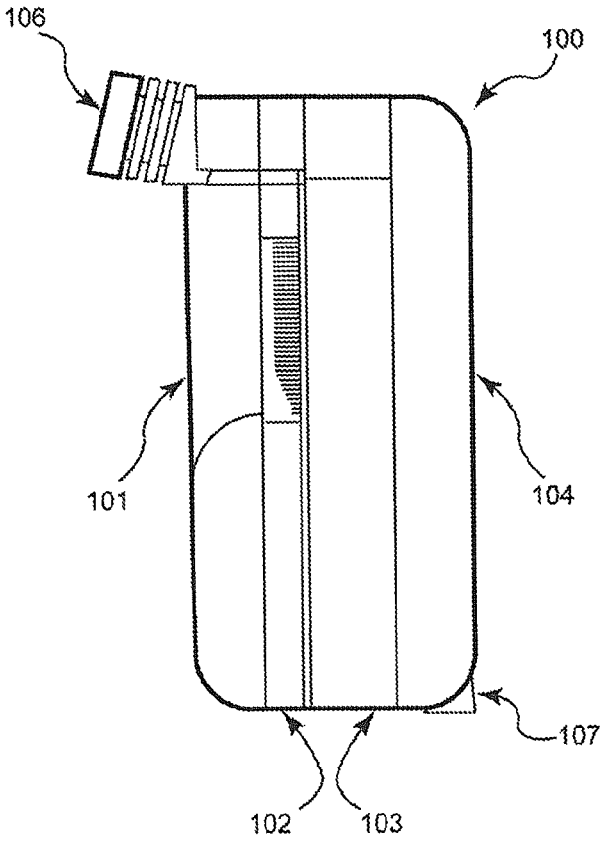
FIG. 1*b*. Side view of the inventive muffler assembled, showing the profile of the intake port flange, and the four removable sections.
Figure 1C:
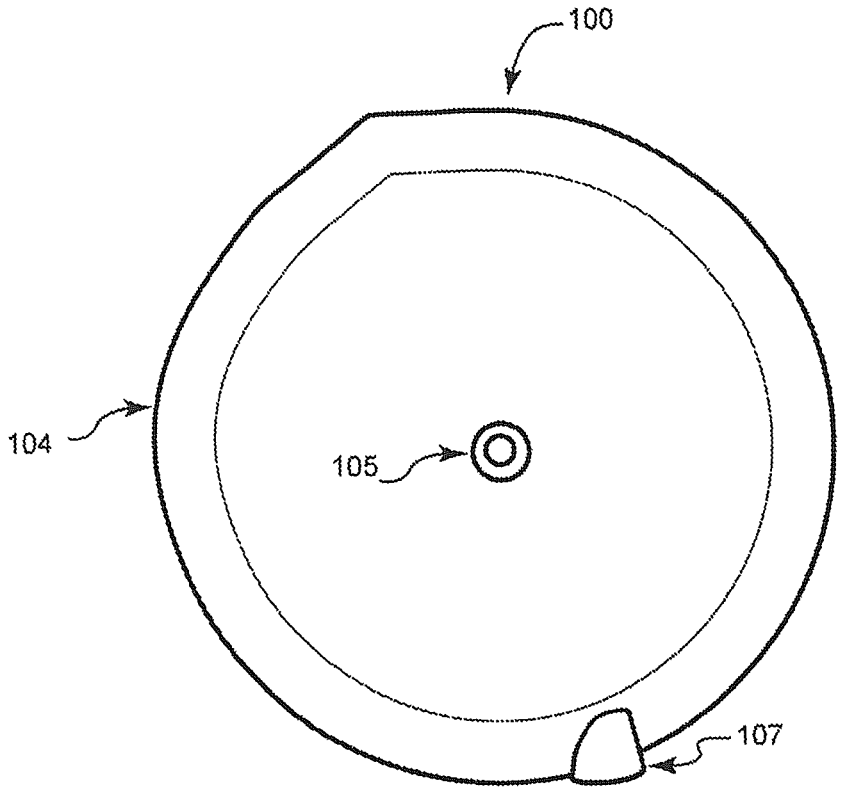
FIG. 1*c*. Inventive muffler—rear (bottom) view showing stinger exhaust port.

Details of the preferred embodiment of the invention will now be described. Referring to FIGS. 1*a* and 1*b*, the inventive muffler body comprises a substantially cylindrical housing shell 100 characterized by a low aspect ratio, whereby the diameter of the housing is larger than its axial length. Housing shell 100 is further subdivided into four removable sections 101-104, described in greater detail below, designed to lock together in a stack formation when assembled. Passage hole 105 is traverses the four sections to allow securing the assembled muffler sections together by a bolt or screw. An exhaust intake port flange 106 is disposed near the edge of the top section for mounting to an exhaust port of a small two-cycle engine. On the reverse side of the housing shell 100, a conical stinger exhaust outlet port 107 is disposed along the edge of the housing shell. It will be appreciated by persons skilled in the art that the exterior positioning of the exhaust intake and outlet ports is not critical to the operation of the muffler, and that other embodiments may incorporate such variations of the placement of these ports without departing from the scope and spirit of the invention.

Figure 2A:
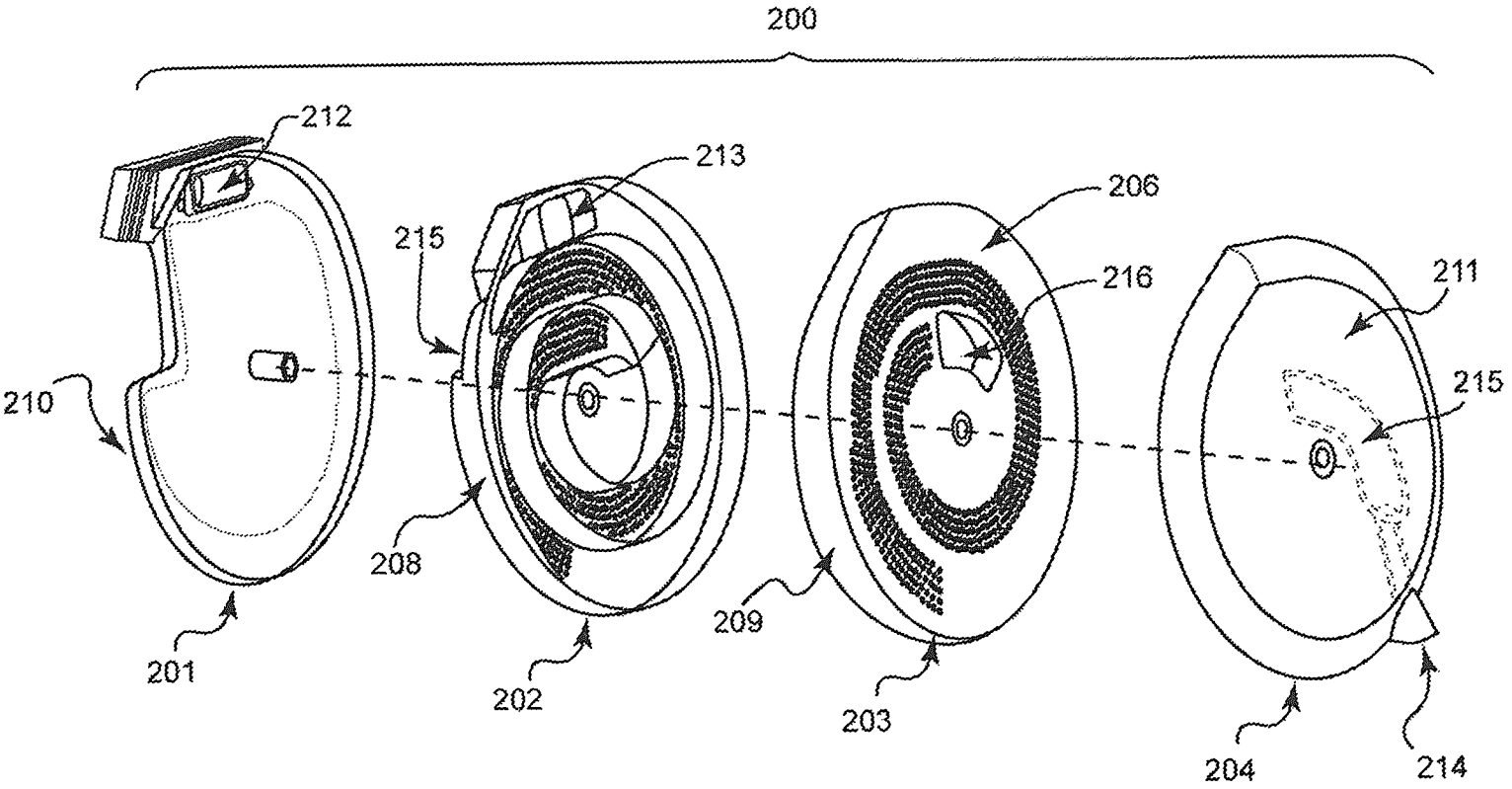
FIG. 2*a*. Exploded view of the inventive muffler, showing some details of the internal components.
Figure 2B:
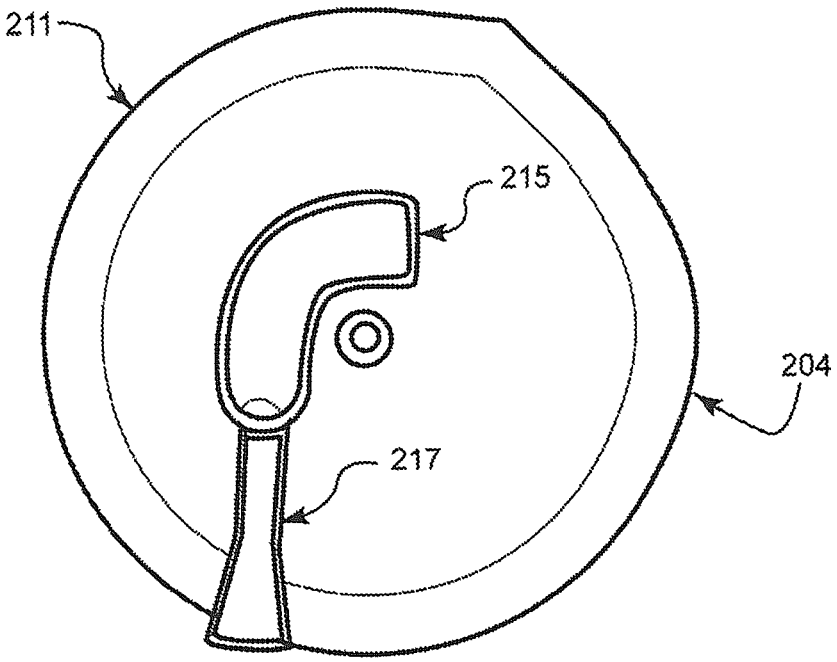
FIG. 2*b*. Plan view of the interior of bottom outer chamber exposing details of stinger exhaust outlet port.

Referring now to FIGS. 2*a* and 2*b*, the interior of housing shell 200 is partitioned into three adjacent chambers along a first and second plane that are both normal to its axis, forming a stack consisting of a middle chamber and two auxiliary outer chambers positioned above and below the middle chamber. FIG. 2*a* shows an exploded view of the sandwich arrangement of the interior chambers. Outer chambers 201 and 204 comprise the first and forth removable sections of housing shell 200, and cap the middle chamber, which is divided into two half sections 202 and 203. The half sections 202 and 203 of the middle chamber are bounded axially by two parallel partitions, or plates 205 and 206, while being bound radially by the second 208 and third 209 removable segments of the muffle housing shell extending between the two partitions, forming an outer wall. The partition plates 205 and 206 are also shared in common with the two outer chambers 201 and 204. The outer chambers are in turn bounded internally the planar partitions 205 and 206 and by upper 210 and lower 211 sections, or first and fourth removable sections, respectively, of the removable muffler housing shell segments extending from the partitions to the end extremities of the shell.

Continuing to refer to FIG. 2*a*, the intake port 212 disposed near the outer edge of the surface of the top chamber and is extended exteriorly from the muffler housing shell by a finned flange for connection to the cylinder's exhaust port. The port 212 penetrates interiorly through the top chamber 201 to the middle chamber half 202 with which it is in communication via an entrance aperture 213 in the partition plate 205 dividing the middle and top chambers. In this way, the interior of top chamber 201 is isolated from the raw exhaust gas entering the muffler body. Similarly, outlet 214 is disposed on the interior of outer chamber 204. Referring to FIG. 2*b*, a view of the interior of chamber 204 is shown. The exhaust port comprises a straight tube 217 whose cross section is narrower than that of the duct 215 leading to it, forming a constriction. Toward the distal end of the port, the tube is flared in a divergent acute angle 214, the combination of the straight tube and flared port forming a stinger. Flared port 214 penetrates through the wall of chamber 204 and connects with one end of duct 215. The opposite extremity of duct 215 covers exit aperture 216 (shown in FIG. 2*a*), which is formed in partition plate 206, thus facilitating communication between the middle chamber and the atmosphere for removal of exhaust gases. Duct 215 and stinger tube 217 are partially formed and integral with the shell section 211 wherein the interior of the duct is exposed when the muffler housing is disassembled. When assembled, the duct and stinger tube seals against partition plate 206, and covering aperture 216. The stinger constriction inhibits the flow rate of escaping gases, thereby increasing the backpressure within the passageway of the muffler, inhibiting the loss of fuel/air mixture charge therein, thereby increasing engine performance, as is well known in the art.

Figure 3A:
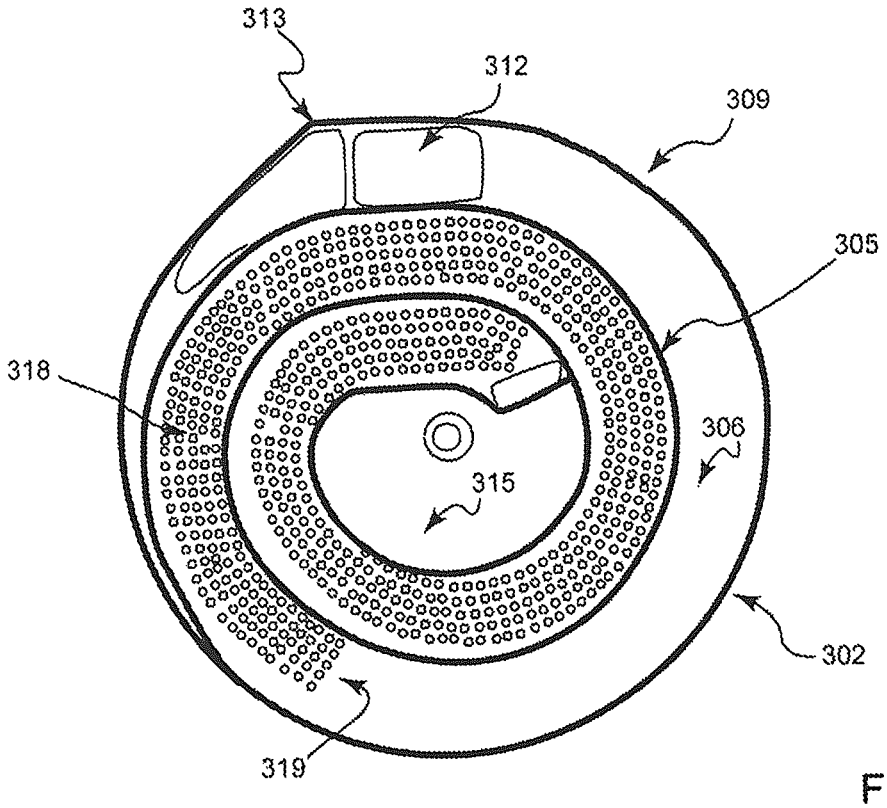
FIG. 3*a*. Plan view of the interior of the top half section of middle chamber, exposing details of entrance aperture, the top half of the spiral exhaust duct with its perforation pattern.
Figure 3B:
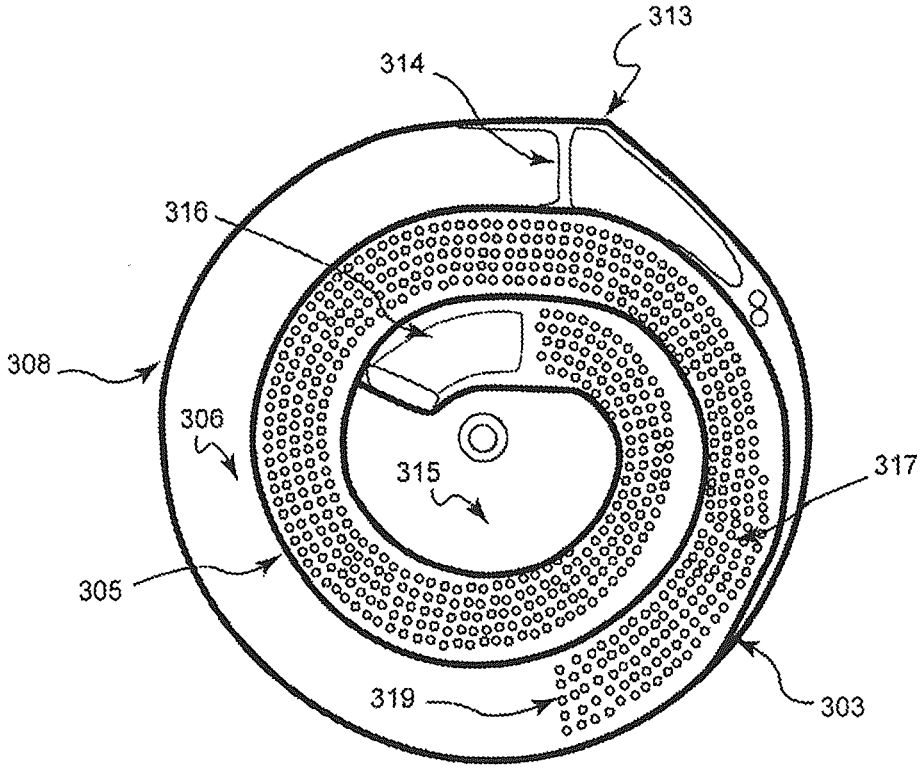
FIG. 3*b*. Plan view of the interior of the bottom half section of middle chamber, exposing details of exit aperture, the bottom half of the spiral exhaust duct, and perforation pattern.

Referring now to FIGS. 3*a* and 3*b*, the interior space of the middle chamber, comprising half sections 302 and 303, is further divided by an interior wall 305 that bifurcates from the outer walls 308 and 309 of each half section, respectively, and spirals inwardly towards the center of the chamber, segmenting the interior space of the middle chamber into a spiral labyrinth. When the muffler is assembled, the spiral contours of the interior wall extend axially, between the first and second partitions (205 and 206 in FIG. 2*a*), forming a spiral duct 306 of constant rectangular cross section that directs exhaust gases entering the muffler from the entrance aperture 312 towards the center of the muffler, wherefrom the exit aperture 316 opens into duct 215 (FIG. 2*b*) leading to the atmosphere via exhaust port stinger 214 (FIG. 2*b*). Upper and lower halves of interior spiral wall 305 are integral with the top and bottom partition plates (205 and 206 of FIG. 2*a*), as well as with the outer wall at the point of bifurcation, respectively. The upper and lower halves of the spiral wall 305 mesh together when assembled, forming a contiguous structure spanning the height of the middle chamber.

Continuing to refer to FIGS. 3*a* and 3*b*, the outer wall 308 and 309 of the middle chamber sections is substantially circular, but in the preferred embodiment has a deformation at a point along its perimeter that forms an obtuse vertex 313 subtended by straight segments of the wall that gradually blend with the greater circular segment arc. The bifurcation of the interior wall 305 from the outer wall occurs near this vertex 313, allowing the cross section of the spiral duct 306 to remain constant along its entire length. The inner wall bifurcates near the vertex 313 at a point approximately coinciding with the convergence of the straight wall segment subtending the vertex with the greater circular arc, initially forming an acute divergence angle with the outer wall, then flattens to become parallel with the straight segment subtending the vertex angle but on the opposite side of the vertex, becoming rounded once more to maintain parallelism with the contour of the outer wall. At this same point a partition wall 314 extends perpendicularly from the outer wall and spans the gap between the inner and outer walls, forming a cul-de-sac and demarking the peripheral terminus of the spiral duct. Aperture 312 leading to the intake port is located at this terminus, thereby defining the peripheral terminus as the entrance to the spiral duct. The inner spirals follow the same pattern to maintain the distance between successive spiral contours equal until the spiral duct terminates in the central portion of the chamber. The inner spiral wall terminates by joining itself along the final spiral segment forming a cul-de-sac and demarking the inner terminus of the spiral duct, also forming an enclosure around an inner space 315 as a consequence. The enclosed inner space 315 serves no function. The exit aperture 316 leading to the exhaust port is located in the cul-de-sac of the inner terminus. Again, a constant rectangular cross section of the spiral duct is maintained by this scheme. Materials of construction for all structural components of the present invention can be metals such as alloys of aluminum, steel, and high temperature plastics such as Torlon® or Zytel HTN®.

In an aspect of the preferred embodiment, the upper and lower plates, comprising the top and bottom of spiral duct 306, are perforated in patterns 317 and 318, respectively, that provide a plurality of perforations that are constrained to occupy the top and bottom of the spiral exhaust passage within the confines of the spiral duct 306, that is, the perforation pattern follows the spiral contours of the duct, thereby allowing communication between the middle chamber and the top and bottom chambers through the plurality of perforations. Exhaust gases can eventually escape into the spaces of the outer chambers through the perforations, which are packed with sound absorbing materials for noise attenuation, such as non-woven glass fiber mat. In one aspect of the preferred embodiment, the degree to which the perforation grouping fills the spiral duct has been found to be essential to the performance of the muffler for engine efficiency. In other words, it is desirable that the perforations do not occupy the total length of the duct, and more specifically do not occupy the fore-portion of the duct between the intake port at the duct entrance and a point 319 downstream, but begin at a distance substantially downstream of the duct entrance and terminate at the duct exit.

Placement of the perforation pattern within the spiral duct in this manner has been found by the inventors to allow exhaust gases entering the muffler to maintain the exit velocity from the engine cylinder for a distance within the duct before encountering the perforations in the duct floor and ceiling, whereby the fore-portion of the spiral exhaust duct functions as a straight header pipe. Thus, the fore-portion of the duct functions as an internal header pipe. The main advantage of this aspect of the invention is that an external header necessary for connecting the muffler to a small two-stroke engine is eliminated, allowing for a more compact mounting of the inventive muffler to the engine and maintaining a smaller engine footprint overall in accordance with the spirit of the invention.

Engine performance is maintained or enhanced relative to a tuned pipe because the header function of the fore-portion of the duct prevents premature dissipation of the exhaust gas energy caused when gases disperse through the perforations to interact with the sound absorbing material, also creating turbulence, as would be the case if the perforations began at the entrance to the duct, thereby minimizing flow resistance within the spiral duct. In light of this discussion, the inventors have found that the length of the internal header is critical for engine performance, and have developed empirical methods to determine the optimal length. The exact placement of the perforation pattern, and hence the length of the internal header, is therefore optimized to produce maximum performance of the particular two-stroke engines to which the inventive muffler is intended to be attached. The following example demonstrates one optimization procedure developed by the inventors for determining the length of the internal header.

Example 1

Procedure for Optimizing the Length of Internal Header

An external straight header pipe of a given length is attached to the exhaust port of a particular small two-stroke engine. The length of the external header is determined empirically by finding the relationship between the engine performance and the length of the header. The optimum external header length required to achieve the maximum engine performance is then determined and used for the optimization of the internal header length. A prototype of the inventive muffler having perforations occupying the entire length of the spiral duct is mounted on the end of the external header. The engine performance is then measured in terms of rpm achieved (or other performance metric) with a given air/fuel mixture. The header pipe is incrementally reduced in length, and engine performance is measured, yielding an inferior result in comparison with the performance observed using the optimal external header length. Subsequently, short segments of the perforated fore-portion of the spiral duct are incrementally covered to compensate for the loss of external header until the maximum engine performance is recovered. This procedure is repeated until the external header is completely removed, resulting in the determination of the maximum length of internal header. Thus, the internal header length is shorter than the external header length giving maximum engine performance, and is optimized for the particular type of engine used for the procedure.

At the same time, a degree of exhaust gas backpressure is maintained within the muffler, mitigating the rate at which the air/fuel charge in the engine cylinder is sucked out of the cylinder before the compression stroke. While the inventive muffler is not a tuned pipe exhaust system as is claimed in a similar muffler design for two-stroke engines disclosed in U.S. Pat. No. 6,684,633, by maintaining a relatively high backpressure for an extended period of time within the duct, the inventive muffler mimics the supercharging action of a two-stroke tuned pipe without creating a reflected pressure wave. However, the backpressure within the inventive muffler is not so high as to inhibit fuel scavenging on the down-stroke of the piston, nor work against the compression stroke.

Noise Reduction

As mentioned above, the outer chambers serve to hold sound dampening material packings, which serve to attenuate low and high frequency noise. Materials such as non-woven glass fiber mat has been used for this purpose, and functions in ways understood in the art. Communication with the exhaust gases flowing in the spiral duct of the middle chamber is accomplished via the perforations decorating the upper and lower partition plates. Gases entering the auxiliary outer chambers via the plurality of perforations undergo expansion and lose pressure and velocity. The sound dampening packing dissipates the sound energy carried by the exhaust gases entering the auxiliary chambers, and the spent exhaust gases re-enter the spiral exhaust chamber to exit to the atmosphere through the stinger.

It will be appreciated by persons skilled in the art that the embodiment described herein is meant to be exemplary for illustrative purposes only, and that other embodiments and configurations are possible without deviating from the scope and spirit of the invention.

We claim:

1. A compact muffler for small engines, comprising:

a spiral-shaped main chamber extending from an inlet port to an outlet port;

a pair of outer chambers, the pair sandwiching the main chamber therebetween; and a pair of planar walls, one wall separating the main chamber from one of the pair of outer chambers and the other wall separating the main chamber from the other of the pair of outer chambers, each of the walls having a plurality of perforations therein to allow fluid communication between the main chamber and each of the outer chambers;

wherein as the main chamber extends from the inlet port to the outlet port, the perforations are absent in the region proximate to the inlet port and are present in the central region of the main chamber and the region proximate to the outlet port.

2. A compact muffler as defined in claim 1, wherein the spiral-shaped main chamber lies in a single plane.

3. A compact muffler as defined in claim 1, wherein the main chamber spirals through at least two full revolutions, and wherein the region of the main chamber that is absent of perforations includes at least the first half-revolution of the spiral.

4. A compact muffler as defined in claim 1, wherein the spiral-shaped main chamber spirals around a longitudinal axis and a radial dimension extends radially from the longitudinal axis in a direction passing through the spiral; and wherein the inlet port allows gas to enter the main chamber in a direction parallel to but offset from the longitudinal axis, and the outlet port allows gas to exit the main chamber in a direction parallel to but offset from the longitudinal axis.

5. A compact muffler as defined in claim 4, wherein the offset for the inlet port is greater than the offset for the outlet port.

6. A compact muffler as defined in claim 4, wherein the outlet port from the main chamber is in fluid communication with a duct defined in one of the outer chambers that allows gas to exit the main chamber in a direction of increasing radial dimension.

7. A compact muffler as defined in claim 6, wherein the direction of increasing radial dimension is orthogonal to the longitudinal axis.

8. A compact muffler as defined in claim 6, wherein the duct includes a portion that flares in the direction of gas exiting the muffler at a divergent acute angle.

9. A compact muffler as defined in claim 1, wherein each of the outer chambers contains a sound-dampening material.

10. A compact muffler as defined in claim 9, wherein the sound-dampening materials comprises glass fiber.

11. A compact muffler for small engines, comprising:

a spiral-shaped main chamber extending from an inlet port to an outlet port;

a pair of outer chambers, the pair sandwiching the main chamber therebetween; and a pair of planar walls, one wall separating the main chamber from one of the pair of outer chambers and the other wall separating the main chamber from the other of the pair of outer chambers, each of the walls having a plurality of perforations therein to allow fluid communication between the main chamber and each of the outer chambers;

wherein the spiral-shaped main chamber spirals around a longitudinal axis and a radial dimension extends radially from the longitudinal axis in a direction passing through the spiral; and wherein the inlet port allows gas to enter the main chamber in a direction parallel to but offset from the longitudinal axis, and the outlet port allows gas to exit the main chamber in a direction parallel to but offset from the longitudinal axis.

12. A compact muffler as defined in claim 11, wherein the outlet port from the main chamber is in fluid communication with a duct defined in one of the outer chambers that allows gas to exit the main chamber in a direction of increasing radial dimension.

13. A compact muffler as defined in claim 12, wherein the direction of increasing radial dimension is orthogonal to the longitudinal axis.

14. A compact muffler as defined in claim 12, wherein the duct includes a portion that flares in the direction of gas exiting the muffler at a divergent acute angle.

15. A compact muffler as defined in claim 11, wherein the main chamber, outer chambers, and planar walls are formed by a plurality of separate members that stack together in a longitudinal direction.

16. A compact muffler for small engines, comprising:

a spiral-shaped main chamber extending from an inlet port to an outlet port;

a pair of outer chambers, the pair sandwiching the main chamber therebetween;

a pair of planar walls, one wall separating the main chamber from one of the pair of outer chambers and the other wall separating the main chamber from the other of the pair of outer chambers, each of the walls having a plurality of perforations therein to allow fluid communication between the main chamber and each of the outer chambers;

wherein the main chamber, outer chambers, and planar walls are formed by a plurality of separate members that stack together in a longitudinal direction;

wherein the spiral-shaped main chamber spirals around a longitudinal axis and a radial dimension extends radially from the longitudinal axis in a direction passing through the spiral; and wherein the inlet port allows gas to enter the main chamber in a direction parallel to but offset from the longitudinal axis, and the outlet port allows gas to exit the main chamber in a direction parallel to but offset from the longitudinal axis.

17. A compact muffler as defined in claim 16, wherein the outlet port from the main chamber is in fluid communication with a duct defined in one of the outer chambers that allows gas to exit the main chamber in a direction of increasing radial dimension.

18. A compact muffler as defined in claim 17, wherein the direction of increasing radial dimension is orthogonal to the longitudinal axis.

19. A compact muffler as defined in claim 17, wherein the duct includes a portion that flares in the direction of gas exiting the muffler at a divergent acute angle.

20. A compact muffler for small engines, comprising:

a main chamber comprising a spiral duct that spirals inwardly from an inlet aperture to an exit aperture;

a first outer chamber on one side of the main chamber;

a second outer chamber on a second side of the main chamber, wherein the main chamber, the first outer chamber, and the second outer chamber are disposed in a stack with the main chamber being located between the first and second outer chambers within the stack;

a first partition between the main chamber and the first outer chamber;

a second partition between the main chamber and the second outer chamber; and an exhaust conduit that extends from the exit aperture of the main chamber, through the second outer chamber, and that discharges to atmosphere;

wherein a first section of the spiral duct extends from the inlet aperture of the main chamber in the direction of the exit aperture of the main chamber and lacks perforations in each of the first and second partitions such that exhaust gas entering the spiral duct through the inlet aperture has to travel a first distance along the spiral duct before being able enter either of the first and second outer chambers, and wherein a remainder of the spiral duct, proceeding from the first section to the exit aperture, includes a plurality of perforations in each of the first and second partitions to accommodate fluid communication between the main chamber and each of the first and second outer chambers; and wherein exhaust gas enters each of the first and second outer chambers only from the main chamber through the plurality of perforations in each of the first and second partitions, and wherein exhaust gas in the first and second outer chambers is required to re-enter the main chamber through the plurality of perforations in the first and second partitions, respectively, in order to be discharged to atmosphere through the exhaust conduit.

21. A compact muffler as defined in claim 20, wherein the exhaust conduit comprises an exhaust duct and a tube, wherein the exhaust duct is disposed over the exit aperture and the tube extends from the exhaust duct to a perimeter of the muffler.

* * * * *